US008403182B2

(12) United States Patent
Lee

(10) Patent No.: US 8,403,182 B2
(45) Date of Patent: Mar. 26, 2013

(54) AIR PUMP TYPE OPERATION DEVICE AND A CONTAINER USING THE SAME

(75) Inventor: Jong Hun Lee, Anyang-si (KR)

(73) Assignee: Yechan Co., Ltd., Gyeonggi-do (KR)

( * ) Notice: Subject to any disclaimer, the term of this patent is extended or adjusted under 35 U.S.C. 154(b) by 326 days.

(21) Appl. No.: 12/918,346

(22) PCT Filed: Feb. 19, 2009

(86) PCT No.: PCT/KR2009/000799

§ 371 (c)(1),
(2), (4) Date: Aug. 19, 2010

(87) PCT Pub. No.: WO2009/104915

PCT Pub. Date: Aug. 27, 2009

(65) Prior Publication Data

US 2010/0327023 A1 Dec. 30, 2010

(30) Foreign Application Priority Data

Feb. 22, 2008 (KR) ..... 10-2008-0061698

(51) Int. Cl.
*B65D 37/00* (2006.01)

(52) U.S. Cl. ..... 222/209; 222/389

(58) Field of Classification Search ..... 222/209, 222/389, 131, 468, 481.5
See application file for complete search history.

(56) References Cited

U.S. PATENT DOCUMENTS

| | | | | |
|---|---|---|---|---|
| 2,228,435 | A * | 1/1941 | Binon | 222/179.5 |
| 2,329,917 | A * | 9/1943 | Lautmann | 222/209 |
| 3,184,120 | A * | 5/1965 | Undi | 222/209 |
| 4,098,434 | A * | 7/1978 | Uhlig | 222/94 |
| 5,115,948 | A * | 5/1992 | Johnson | 222/209 |
| 5,215,229 | A * | 6/1993 | Johnson | 222/209 |
| 5,312,018 | A * | 5/1994 | Evezich | 222/95 |
| RE35,354 | E * | 10/1996 | Kersten et al. | 222/209 |
| 5,680,966 | A * | 10/1997 | Johnson | 222/209 |
| 6,742,676 | B2 * | 6/2004 | Nakamura et al. | 222/95 |
| 2004/0074923 | A1 * | 4/2004 | Bang | 222/209 |
| 2006/0043116 | A1 | 3/2006 | Kawashiro et al. | |

FOREIGN PATENT DOCUMENTS

| | | |
|---|---|---|
| JP | 52-163446 | 12/1977 |
| JP | 60-251061 | 12/1985 |
| JP | 2000-226083 | 8/2000 |
| KR | 10-2001-00712101 | 7/2001 |

OTHER PUBLICATIONS

International Search Report dated Oct. 8, 2009.
Korean Office Action with translation dated Aug. 28, 2009.
Korean Office Action with translation dated Feb. 16, 2010.

* cited by examiner

*Primary Examiner* — Kevin P Shaver
*Assistant Examiner* — Donnell Long
(74) *Attorney, Agent, or Firm* — RatnerPrestia

(57) ABSTRACT

The present invention relates to an air pump type corrugated pipe that holds highly viscose material such as toothpaste in a cylindrical container combined with the corrugated pipe and expels contents using air pressure according to compression of the corrugated pipe, and a container using the same. The container includes an air pump type operation device, a tube type body, and a piston. According to the present invention having such structure, highly viscose material is expelled easily and clearly without residue, thereby economic loss is reduced and convenience in use is provided, also the cost of the container is cheap due to its simple constitution.

14 Claims, 9 Drawing Sheets

AIR PUMP TYPE OPERATION DEVICE AND A CONTAINER USING THE SAME

TECHNICAL FIELD

The present invention generally relates to an air pump type corrugated pipe that holds high viscosity material such as toothpaste in a cylindrical container combined with the corrugated pipe and expels contents using air pressure according to compression of the corrugated pipe, and a container using the same.

BACKGROUND ART

Generally, products such as toothpaste containers or cosmetics containers are molded lengthwise in a thin tube shape using soft plastic etc and provided with contents filled inside.

FIG. 10 of the accompanied drawings shows a prior toothpaste container.

In referring to FIG. 10, the toothpaste container according to the prior art includes a body (2) with toothpaste filled, and an outlet (4) integrated with the body (2). Though not shown, an extra lid may be provided and combined with the outlet (4). One end of the body (2) is closed with omission, and the other end of the body (2) has the shape of a funnel as the outlet (4) provided to expel contents from within. In using such a toothpaste container, a user should push the body (2) to expel the contents the outlet (4). However, in using the prior toothpaste container, if a very small amount of the contents remains in the container, due to the property of the container, the user should wrinkle the body (2) and push the container strongly to turn the contents out, or cut the container with scissors and collect the contents. Even with such a procedure the contents are fully expelled resulting in wastage, thereby there is a problem that the user experiences inconvenience. To solve such problem, a pump container was provided. The pump container has the shape of hollow tube body with a piston mainly combined at bottom to expel the inside material out. However, in case of the prior pump container, it is not easy to expel the highly viscose material and there is a problem that the cost of the container itself is expensive because the container has many components.

DISCLOSURE

Technical Problem

To solve the abovementioned problem, the present invention is to provide an air pump type operation device that reduces the number of component and costs, expels the highly viscose material out without residue and also with ease, and a container using the same.

Technical Solution

To achieve the object, the air pump type operation device according to the present invention is characterized by including a tube type body which holds viscose material within and has an outlet, and a hollow body of which one end is combined with the tube type body and the shape is restorable by elasticity, as means for pressing the piston of a container including the piston which is installed inside the tube type body and presses viscose material to be turned out through the outlet, wherein the body is provided with an air inlet, wherein in case that the body is pressed in sealed status the piston is moved by air pressure while internal volume of the body is maintained, and wherein in case that the force applied to the body is released while air is flown in through the air inlet, the shape of the body is restored.

Preferably, the operation device is a corrugated pipe which has a hollow elastic body and is provided with pushing part having an air inlet at one end of the body, wherein, in case of the pushing part's being pressed, the body is shrunk, and in case of releasing of the force applied to the pushing part, air is flown in through the air inlet so that the body is restored.

Meanwhile, the container according to the present invention includes a tube type body which holds viscose material within, of which one end is open, and of which the other end is projected at the center to make a funnel shape and is provided with an outlet projected at the center of the other end; a piston which is installed inside the tube type body and turns the viscose material out through the outlet by pressing it; and an air pump type corrugated pipe which has a hollow elastic body of which one end is combined with the open end of the tube type body coaxially, and which is provided with pushing part having an air inlet at the other end of the body, wherein in case of pressing the pushing part, the closed internal volume of the body is maintained and the piston is moved by the air pressure, and in case of releasing the force applied to the pushing part, air is flown in through the air inlet and the shape of the body is restored.

In the present invention, the air inlet may be provided at center of the pushing part on the center axis of the corrugated pipe to be closed in case of user's pressing the pushing part, or may be provided on the plane of circumference perpendicular to the center axis of the corrugated pipe to maintain the open status regardless of the user's contacting of the pushing part.

Preferably, a one-way open check valve for flowing air in the operation device through the air inlet of the operation device is provided inside the operation device.

Preferably, a helicoidal surface is provided at the outer peripheral surface of one end of the operation device, and in response, a helicoidal surface is provided at the inner peripheral surface of one end of the tube type body, thereby the operation device and the tube type body each other are combined with a screw union.

Preferably, the air inlet is provided on the circumference surface of one end of the tube type body.

Preferably, the piston is provided as the shape corresponding to sticking the inner surface of the other end of the tube type body.

Preferably, the operation device and tube type body consist of transparent material.

Preferably, the tube type body further includes a lid to be screw-combined at one end.

Preferably, the tube type body further includes a protection cover for being equipped to surround the outer peripheral surface of the tube type body, and a protection cap which is equipped in the protection cover and surrounds the air pump type corrugated pipe, and has an incline cutting plane that cut inclinedly from one end to another so that user can press some part of the air pump type corrugated pipe.

Technical Effect

According to the present invention having such a structure, highly viscose material is expelled out easily and clearly without residue, thereby economic loss is reduced and convenience in use is provided, also cost of the container is cheap due to its simple constitution.

BEST MODE

Now, various embodiments of the present invention will be specifically described with reference to the accompanying drawings.

Figure 1:
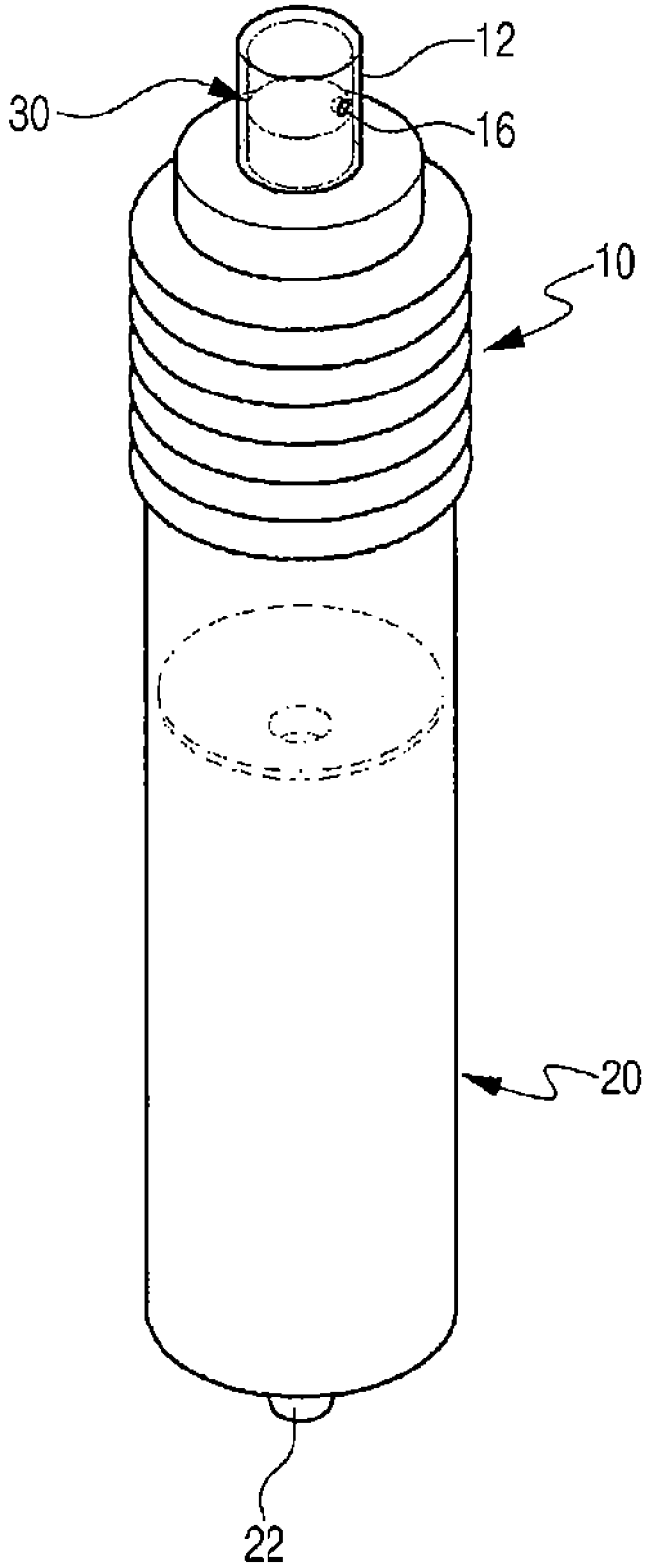
FIG. 1 is a perspective view showing a container having an air pump type operation device according to the first embodiment of the present invention.
Figure 2:
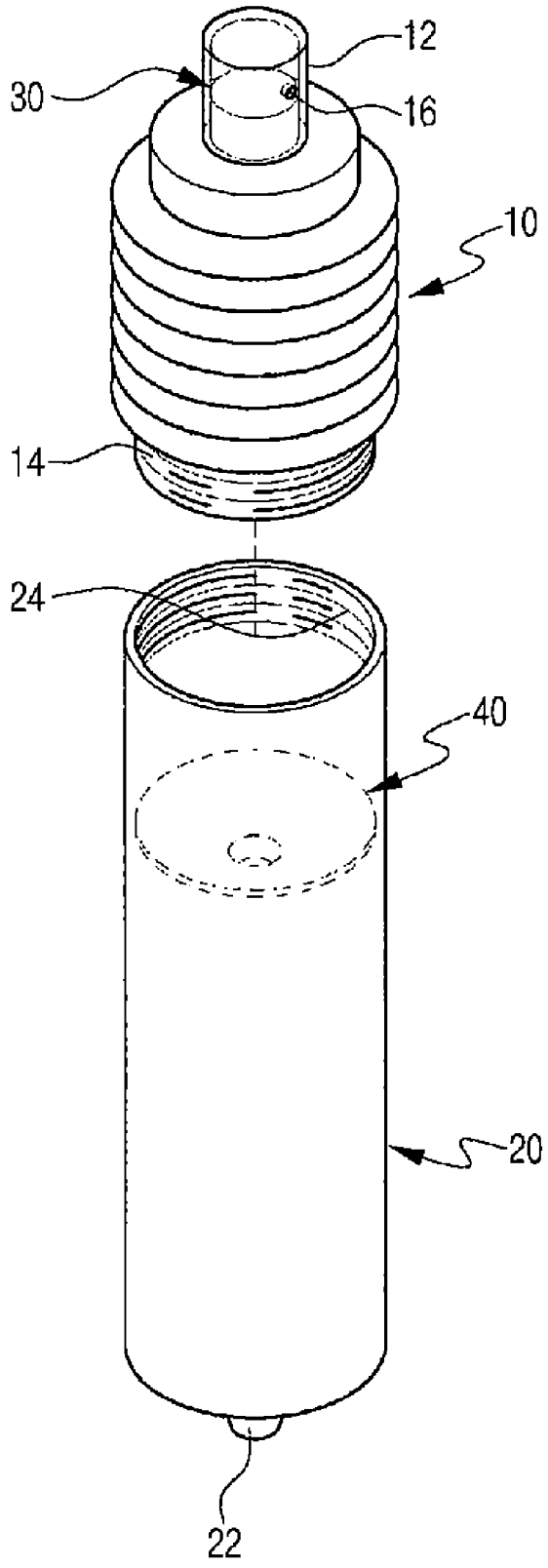
FIG. 2 is a developed perspective view of FIG. 1.
Figure 3:
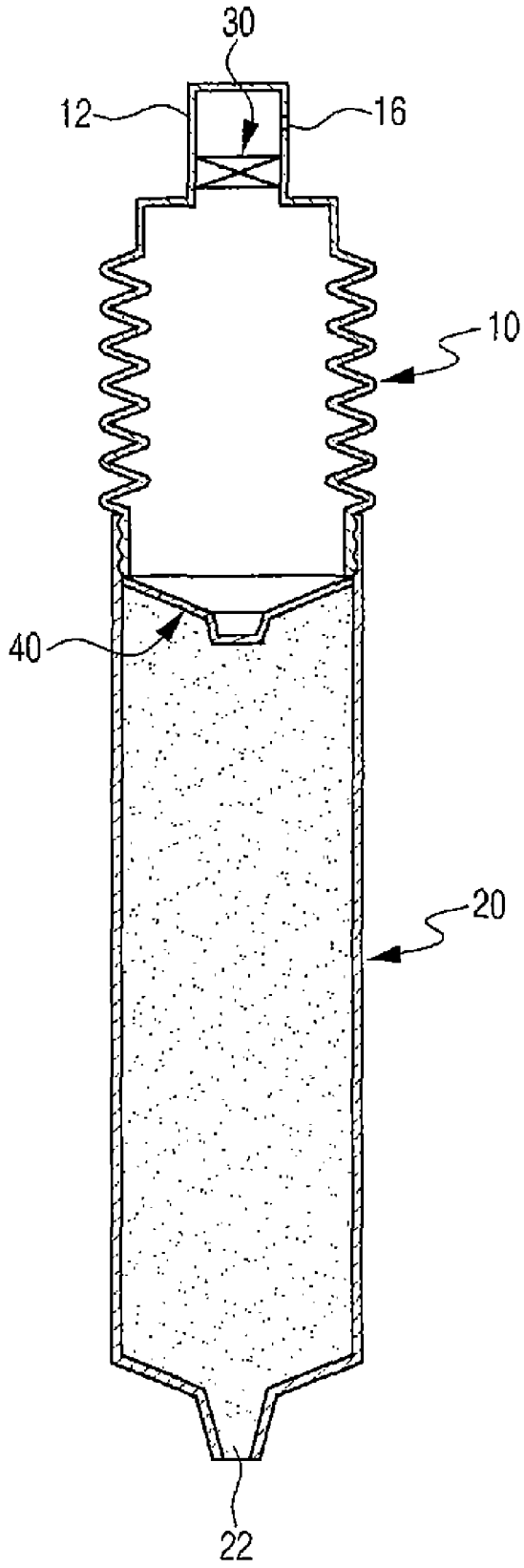
FIG. 3 is a cross section of the container according to the first embodiment of the present invention.

In the accompanying drawings, a container having an air pump type operation device according to first embodiment of the present invention is shown at FIGS. 1 to 3.

In referring to FIGS. 1 to 3, the container consists of a corrugated pipe (10) and a tube type body (20) that are combined with each other. The corrugated pipe (10) is open at its lower end. The outer peripheral surface of the lower end is provided with a helicoidal surface (14), and a closed upper end of the corrugated pipe (10) is provided with a pushing part (12). The pushing part (12) has the shape which some of the upper end of the pushing part (12) projects and has interior space, and the side of the pushing part (12) is provided with a air inlet (16). Then, interior of the pushing part (12) is provided with a one-way open check valve (30) for air to be flowed in the corrugated pipe (10) through the air inlet (16).

The tube type body (20) is provided with a helicoidal surface (24) at its open upper end and screw-combined with the lower end of the corrugated pipe (10), and holds viscose material within. The materials that can be held in the tube type body (20) are diverse such as toothpaste, cosmetics, mayonnaise, red chili-pepper paste with vinegar, ketchup, starch syrup, horseradish, honey, jam, and so on. The lower end of the tube type body (20) projects toward down at center and is shaped with a funnel, and is provided with an outlet (22) projected at the center of the lower end. A piston (40) is installed within the tube type body (20). The piston (40) is provided to be moved by air pressure and to press the viscose material, and is provided to have the shape corresponding to contacting the inner surface of the lower end of the tube type body (20). Though not shown, the outlet (22) of the lower end of tube type body (20) may be combined with an extra lid.

Meanwhile, for the user to check residue of the content, the corrugated pipe (10) and the tube type body (20) both may consist of a transparent material or either of them may consist of a transparent material.

Figure 4:
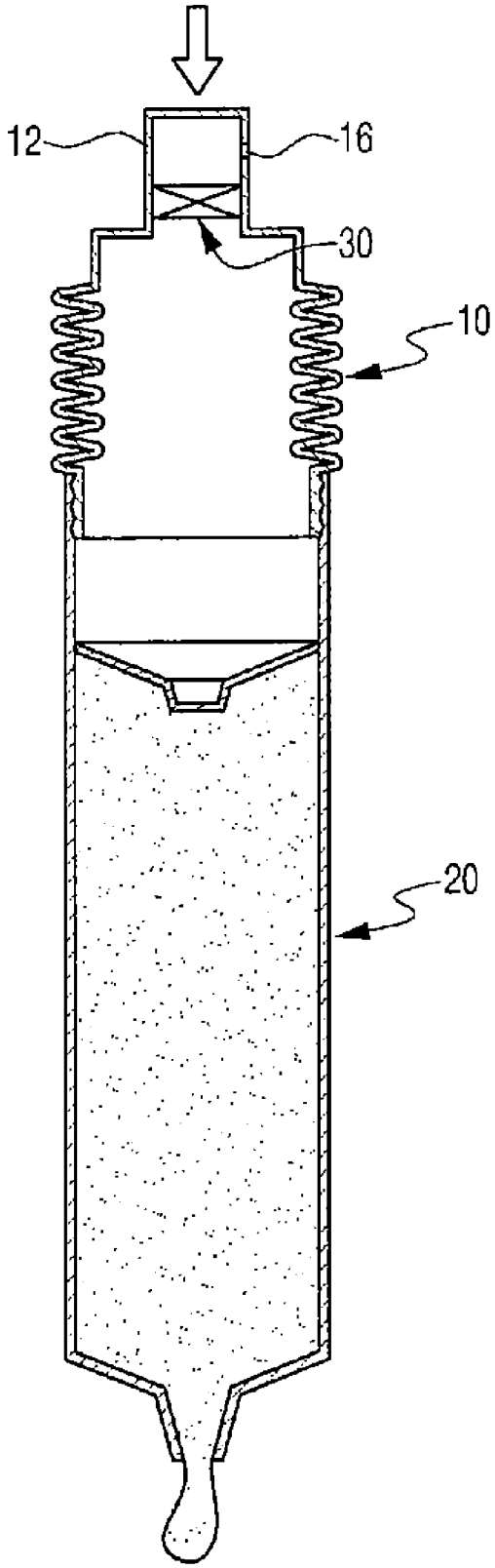
FIG. 4 is a cross section of FIG. 3 in use.

FIG. 4 shows the operating status of the container according to the first embodiment of the present invention.

In referring to FIG. 4, as the status that the user pushes the pushing part (12) of the corrugated pipe (10), some of the content of the tube type body (20) is expelled. That is, if the corrugated pipe (10) is pressed as FIG. 4 from the status of the corrugated pipe (10) of FIG. 3, the interior volume of the corrugated pipe (10) as closed space is maintained as the same, thereby the piston (40) is moved by air pressure as the length of the corrugated pipe (10) reduces. Accordingly, the content of the tube type body (20) is expelled through the outlet (22). Then, releasing the force applied to the corrugated pipe (10), the corrugated pipe (10) is restored from the status of FIG. 4 to the status of FIG. 3. At this time, because air is flowed in the corrugated pipe (10) through the check valve (30) in one-way with the air inlet (16), the shape of the corrugated pipe (10) is restored with it's interior volume expansion and the piston (40) is maintained without a change of a position. Here, the air inlet (16) maintains continuous open status even if the user continuously contacts the pushing part (12), thereby the corrugated pipe (10) may be smoothly restored.

Like this, as the user repeats the action of pushing the pushing part (12) of the corrugated pipe (10), the content in the corrugated pipe (20) is continuously expelled. Also, the piston (40) is provided with the shape corresponding to the inner surface of the lower end of the tube type body (20), thereby the content of the tube type body (20) is fully expelled.

Figure 5:
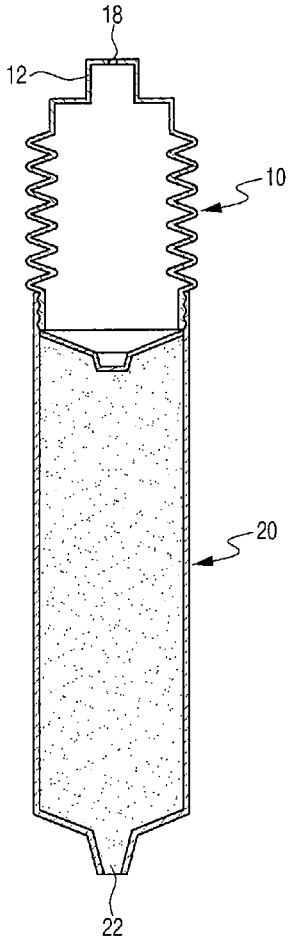
FIG. 5 is a perspective view showing a container having an air pump type operation device according to the second embodiment of the present invention.
Figure 6:
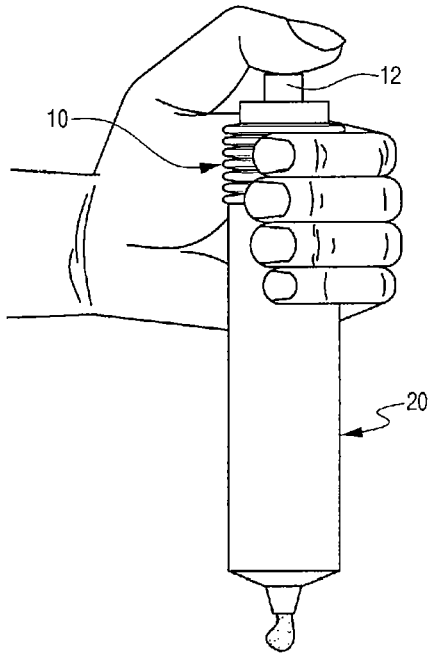
FIG. 6 is a cross section of FIG. 5 in use.

In FIGS. 5 and 6 of the accompanying drawings, the container having an air pump type operating device according to the second embodiment of the present invention is shown.

In referring to FIG. 5, the container according to the second embodiment of the present invention has a similar structure as shown in FIGS. 1 to 3, and has a smaller number of components because it does not have the check valve. The lower end of the corrugated pipe (10) and the upper end of the tube type body (20) are screw-combined each other. The closed upper end of the corrugated pipe (10) is provided with the pushing part (12), and the upper center of the pushing part (12) in a coaxial position with the corrugated pipe (10) is provided with the air inlet (18). The center of the lower end of the corrugated pipe (20) is provided with the outlet (22) with projected, and the piston (40) is installed within.

Meanwhile, in referring to FIGS. 5 and 6, the operation of the container according to the second embodiment of the present invention is explained.

As shown in FIG. 6, if the user presses the pushing part (12) of the corrugated pipe (10) while blocking the air inlet (18), the interior of the corrugated pipe (10) is to be sealing space. Here, because the interior volume of the corrugated pipe (10) is maintained as it is, the piston (40) is moved by air pressure as the length of the corrugated pipe (10) is reduced. Thus, the content of the tube type body (20) is expelled through the outlet (22). Then, if the user takes his hand blocking the air inlet (18) off and releases the force applied to the corrugated pipe (10), air is supplied in the corrugated pipe (10) through the inlet (18) and the shape of the corrugated pipe (10) is restored.

Figure 7:
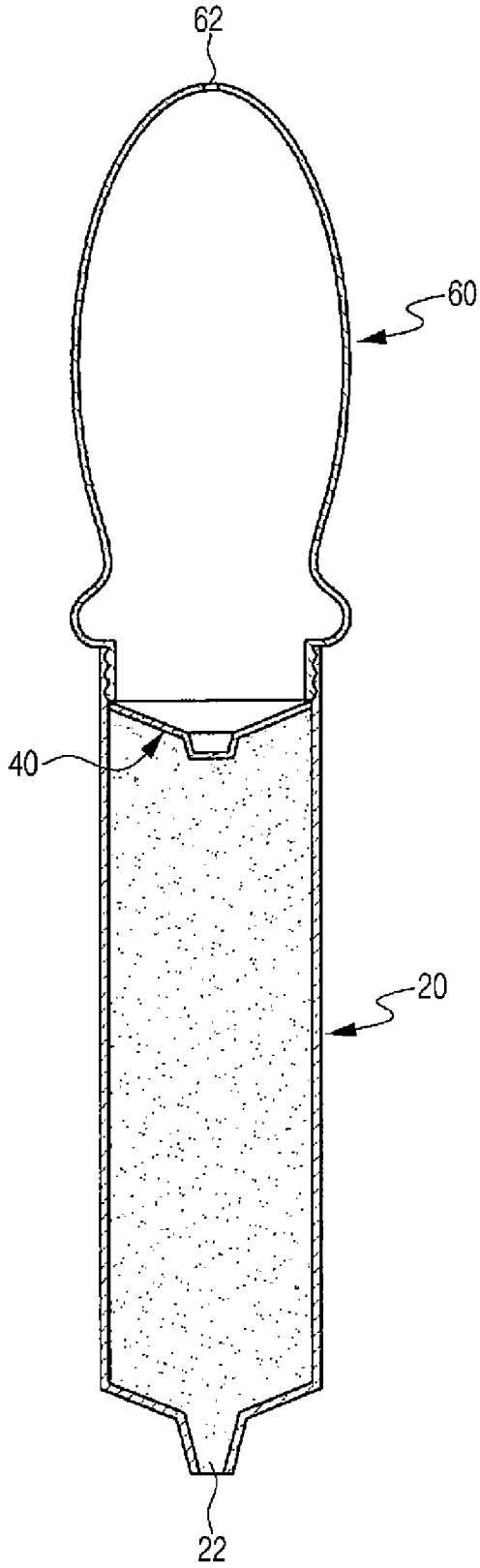
FIG. 7 is a perspective view showing a container having an air pump type operation device according to the third embodiment of the present invention.

Meanwhile, FIG. 7 shows the container having an air pump type operation device according to the third embodiment of the present invention.

In referring to FIG. 7, the air pump type operation device according to the third embodiment of the present invention is a rubber pocket (60). The lower end of the rubber pocket (60) and the upper end of the tube type body (20) are screw-combined each other, and the closed upper center of the rubber pocket (60) is provided with an air inlet (62). Also, though not shown, the rubber pocket (60) may be provided as the shape fitted into the outer periphery of upper end of the tube type body (20).

Figure 8:
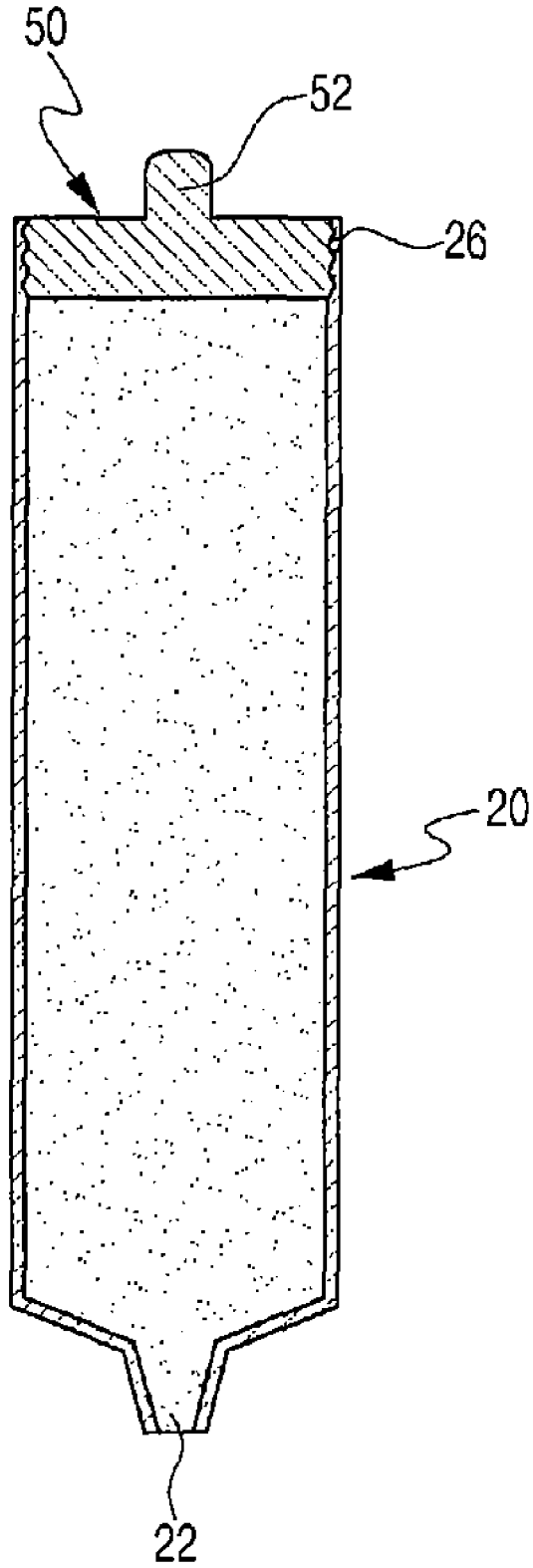
FIG. 8 is a cross section of a tube type body to be applied to the present invention.

Meanwhile, FIG. 8 shows the tube type body for exchange applied to the present invention.

In case of the container according to the present invention, if the content is consumed completely, an extra tube type body (20) filled fully with the content is exchanged and combined with the corrugated pipe (10) or the rubber pocket (60), and may be used. In referring to FIG. 8, such an exchangeable tube type body (20) has a lid (50) and is provided as a separate product. That is, after filling the content into the tube type body (20), the upper end of the tube type body (20) is screw-combined with the lid (50). At this time, the circumference of the upper end of the tube type body (20) is provided with an air inlet (26), thereby the combination is achieved smoothly because the air in the tube type body (20) gets out when the lid (50) is combined with the tube type body (20). Also, the lid (50) may be screw-combined with the tube type body (20), thereby the air inlet (26) of the tube type body (20) can be sealed. Though not shown, the outlet (22) of the lower end of the tube type body (20) will be sealed by an extra lid.

In case of using such exchangeable tube type body (20) combined with the corrugated pipe (10) or the rubber pocket (60), the user grips the knob of the lid (50) of the tube type body (20) and turns and removes the lid (50), then puts the piston (40) into the upper end of the tube type body (20) and screw-combines the upper end of the tube type body (20) with the lower end of the corrugated pipe (10) or the rubber pocket (60) and uses it.

Figure 9:
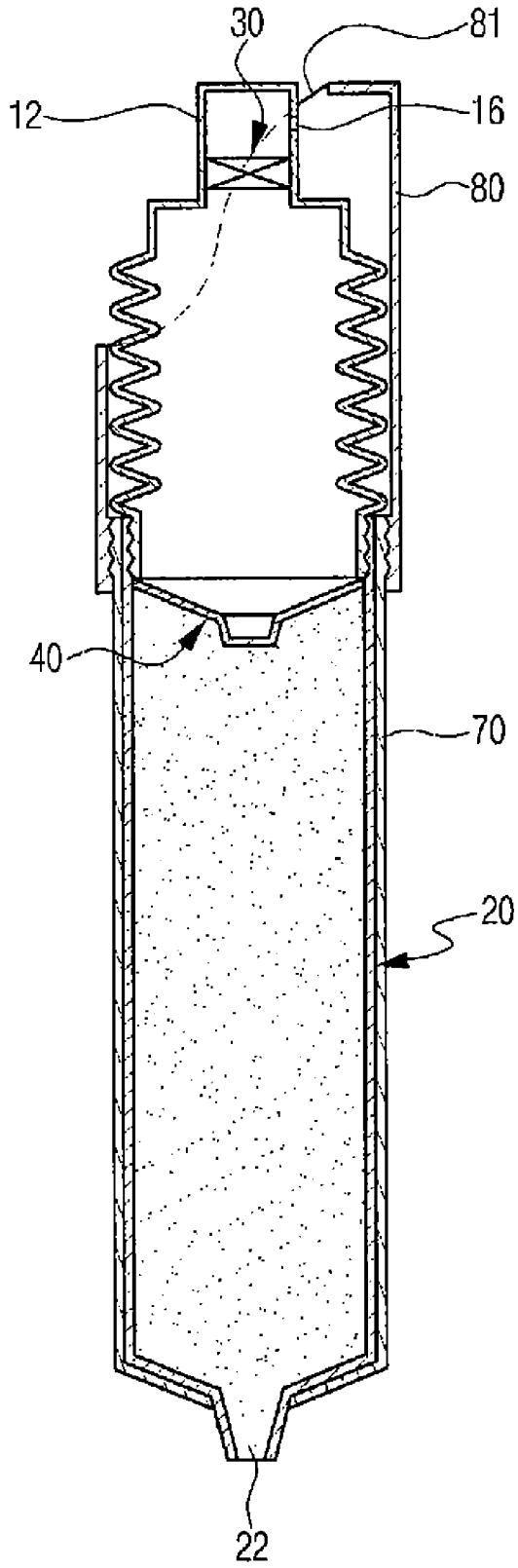
FIG. 9 is a perspective view showing a container having an air pump type operation device according to the fourth embodiment of the present invention.
Figure 10:
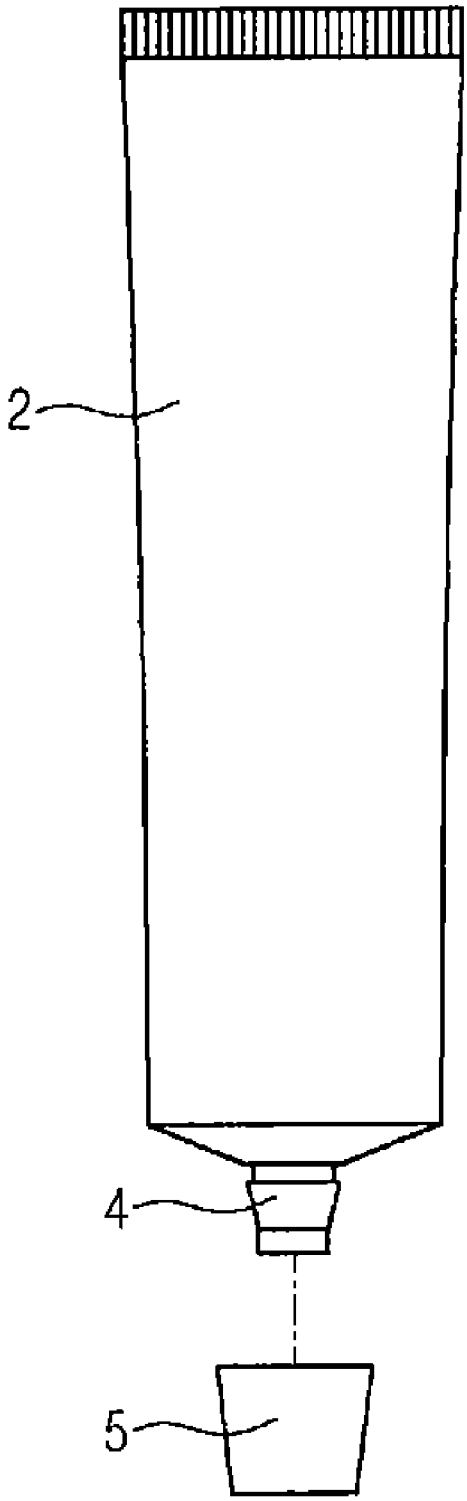
FIG. 10 is a perspective view of a toothpaste container according to the prior art.

Meanwhile, FIG. 9 shows the container having an air pump type operation device according to the fourth embodiment of the present invention.

In referring to FIG. 9, in the container having an air pump type operation device according to the fourth embodiment of the present invention, the tube type body (20) is further equipped with a protection cover (70) and a protection cap (80). The protection cover (70) has the shape having the inner peripheral surface corresponding to the outer peripheral surface of the tube type body (20) and surrounds the tube type body (20), carries out the function for protecting the tube type body (20) from the outside. In case that the content filled into the tube type body (20) is completely consumed, the user exchanges only the tube type body (20) into new material and use it. The protection cap (80) is screw-combined at the upper end of the protection cover (70). The protection cap (80) has the shape surrounding the air pump type corrugated pipe (10), and has an incline cutting plane (81) cut at an incline at the tip of the upper end. Some of the outer peripheral surface of the air pump type corrugated pipe (10) is exposed to the outside through the incline cutting plane (81), thereby the user presses the exposed part and uses it. That is, as usual, the protection cap (80) protects the air pump type corrugated pipe (10) and prevents the content filled into the tube type body (20) from leaking out by any impact.

As explained above, the container having the air pump type operation device according to the present invention can expel highly viscose material out easily and clearly without residue, thereby reduce economic loss and provide the user with convenience of use.

Also, the container having the air pump type operation device according to the present invention consists simply of a small number of components, thereby the price of the container can be lowered. Meanwhile, the container having the air pump type operation device according to the present invention can be used as the container for groceries such as mayonnaise, red chili-pepper paste with vinegar, ketchup, starch syrup, horseradish, honey, jam, and so on. Also, the container can be used as the product for exchanging only the tube type body.

The foregoing embodiments of the invention have been presented for the purpose of illustration and description only. They are not intended to be exhaustive or to limit the invention to the forms disclosed. Accordingly, the scope of the invention is defined by the appended claims, not the preceding disclosure.

The invention claimed is:

1. An air pump type operation device for pressing a piston in a container comprising:

a tube type body for holding viscose material within, the tube type body having air inlets and an outlet, and the piston which is installed in the tube type body presses and expels the viscose material through the outlet, wherein the air pump type operation device has a hollow body of which one end is combined with the tube type body and which is restorable by elasticity, wherein in the case of pressing the body while sealed the interior volume of the body is maintained and the piston is moved by air pressure, wherein in the case of releasing the force applied to the body while air is flowing in through the air inlets the shape of the body is restored, and wherein the tube type body further includes:

a protection cover for being equipped to surround the outer peripheral surface of the tube type body; and a protection cap which is equipped on the protection cover and surrounds the air pump type corrugated pipe, and has an incline cutting plane cut at an incline from one end to another so that the user can press some part of the air pump type corrugated pipe.

2. The air pump type operation device of claim 1, wherein the operation device is a corrugated pipe that has a hollow elastic body, wherein the other end of the body is provided with a pushing part of the air inlets, and wherein in the case of pressing the pushing part the body is shrunk and in the case of releasing the force applied to the pushing part air is flowed in through the air inlets and the body is restored.

3. The air pump type operation device of claim 2, wherein the air inlet is provided at the center of the pushing part on the central axis of the corrugated pipe so that the air inlet is closed when user pushes the body of the corrugated pipe.

4. The air pump type operation device of claim 2, wherein the interior of the pushing part is provided with a one-way open check valve, wherein the one-way check valve prevents air from leaking to the outside of the corrugated pipe and allows air to flow into the interior of the corrugated pipe through the air inlet.

5. The air pump type operation device of claim 4, wherein the air inlet is provided at the circumference surface of the pushing part perpendicular to the central axis of the corrugated pipe so that the air inlet is maintained in open status regardless of the user's contact with the pushing part.

6. A container comprising:

a tube type body which holds viscose material within, of which one end is open, and of which the other end is projected at the center to make a funnel shape and is provided with an outlet projected at the center of the other end;

a piston which is installed inside the tube type body and expels the viscose material through the outlet by pressing it; and an air pump type corrugated pipe which has a hollow elastic body of which one end is combined with the open end of the tube type body coaxially, and which is provided with a pushing part having air inlets at the other end of the body, wherein in the case of pressing the pushing part, the closed internal volume of the body is maintained with the body shrunk and the piston is moved by the air pressure, and in the case of releasing the force applied to the pushing part, air is flown in through the air inlets and the shape of the body is restored, wherein the tube type body further includes:

a protection cover for being equipped to surround the outer peripheral surface of the tube type body; and a protection cap which is equipped on the protection cover and surrounds the air pump type corrugated pipe, and has an incline cutting plane cut at an incline from one end to another so that the user can press some part of the air pump type corrugated pipe.

7. The container of claim 6, wherein the air inlet is provided at center of the pushing part on the center axis of the corrugated pipe to be closed in the case of the user's pressing of the pushing part.

8. The container of claim 6, wherein a one-way open check valve for preventing air from leaking to the outside of the corrugated pipe and allowing the air to flow in the corrugated pipe is provided at the interior of the pushing part.

9. The container of claim 8, wherein the air inlet is provided on the circumference surface of the pushing part perpendicular to the center axis of the corrugated pipe to maintain the open status regardless of the user's contacting of the pushing part.

10. The container of claim 6, wherein a helicoidal surface is provided at the outer peripheral surface of one end of the corrugated pipe, and in response, a helicoidal surface is provided at the inner peripheral surface of one end of the tube type body, thereby the corrugated pipe and the tube type body each other are combined with a screw union.

11. The container of claim 6, wherein the air inlet is provided on the circumference surface of one end of the tube type body.

12. The container of claim 6, wherein the piston has a shape corresponding to an inner surface of the other end of the tube type body.

13. The container of claim 6, wherein the corrugated pipe and tube type body consist of a transparent material.

14. The container of claim 6, wherein by further including a lid to be screw-combined at the one end of the tube type body.

* * * * *